US009943143B2

(12) United States Patent
Nezuka

(10) Patent No.: US 9,943,143 B2
(45) Date of Patent: Apr. 17, 2018

(54) ROD-LIKE BODY AND METHOD FOR PRODUCING THE SAME

(75) Inventor: Masakichi Nezuka, Tokyo (JP)

(73) Assignee: KIYOHARA KABUSHIKI KAISHA, Osaka (JP)

( * ) Notice: Subject to any disclaimer, the term of this patent is extended or adjusted under 35 U.S.C. 154(b) by 686 days.

(21) Appl. No.: 13/616,073

(22) Filed: Sep. 14, 2012

(65) Prior Publication Data

US 2013/0025318 A1 Jan. 31, 2013

Related U.S. Application Data

(62) Division of application No. 12/670,679, filed as application No. PCT/JP2007/065090 on Aug. 1, 2007, now abandoned.

(51) Int. Cl.

| | |
|---|---|
| ***A44C 11/00*** | (2006.01) |
| ***D04D 1/02*** | (2006.01) |
| ***D04D 9/00*** | (2006.01) |

(52) U.S. Cl.

CPC ..... *A44C 11/002* (2013.01); *D04D 1/02* (2013.01); *D04D 9/00* (2013.01); *A41D 2200/10* (2013.01)

(58) Field of Classification Search

CPC ..... A44C 11/002

See application file for complete search history.

(56) References Cited

U.S. PATENT DOCUMENTS

| | | | | |
|---|---|---|---|---|
| 1,515,499 | A * | 11/1924 | Lederer | 59/79.2 |
| 4,123,305 | A * | 10/1978 | Krzeszowski | 156/71 |
| 5,103,816 | A * | 4/1992 | Kirschbaum et al. | 128/207.14 |
| 5,190,810 | A * | 3/1993 | Kirschbaum et al. | 442/234 |
| 5,279,132 | A * | 1/1994 | Swaim | 63/3.1 |
| 5,359,798 | A * | 11/1994 | Pelosi | 40/661.06 |
| 5,590,546 | A * | 1/1997 | Hector | 63/38 |
| 5,694,791 | A * | 12/1997 | Esposito | 63/3 |
| 6,634,184 | B2 * | 10/2003 | Feldman | 63/26 |

(Continued)

FOREIGN PATENT DOCUMENTS

| | | |
|---|---|---|
| CN | 2673455 Y | 1/2005 |
| JP | 2006-181151 | 7/2006 |

(Continued)

OTHER PUBLICATIONS

Machine Translation of JP2006-181151.*

(Continued)

*Primary Examiner* — Emily M Morgan

(74) *Attorney, Agent, or Firm* — Kratz, Quintos & Hanson, LLP

(57) ABSTRACT

An ornamental rod-like body includes a strap-shaped ornamental body 1 for ornamental purposes includes a multiple granular ornamental bodies 2 selected from the group consisting of jewel, artificial jewel 2A, bead, noble-metal ball, and metal ball; a connecting member 3 configured to arrange the granular ornamental bodies in a plurality of rows and connect them to each other; and an adhesion member having a adhesive layer 4 made of hot-melt adhesive configured to be adhered to a backside of the connecting member. The strap-shaped ornamental body is adhered and secured via the adhesion member in a state where granular ornamental bodies are wound and exposed radially outward of the adhesion member.

4 Claims, 11 Drawing Sheets

(56) References Cited

U.S. PATENT DOCUMENTS

| | | | | |
|---|---|---|---|---|
| 7,108,910 | B1 * | 9/2006 | Smith et al. | 428/354 |
| 2001/0032481 | A1 * | 10/2001 | Takessian | 63/29.1 |
| 2002/0189283 | A1 * | 12/2002 | Chia et al. | 63/4 |
| 2010/0024482 | A1 * | 2/2010 | Nevatia | 63/26 |

FOREIGN PATENT DOCUMENTS

| | | | |
|---|---|---|---|
| JP | 2006181151 | A * | 7/2006 |
| WO | WO 2007075724 | A2 * | 7/2007 |

OTHER PUBLICATIONS

Translation of JP2006181151 Nezuka written by STIC.*
Notification of First Office Action dated Dec. 31, 2013 from the State Intellectual Property Office of the People's Republic of China in counterpart application No. 201210387123.6 with English translation.
Notification of the Second Office Action dated Aug. 15, 2014 from the State Intellectual Property Office of the People's Republic of China in counterpart application No. 201210387123.6 with English translation.

* cited by examiner

ROD-LIKE BODY AND METHOD FOR PRODUCING THE SAME

RELATED APPLICATIONS

This application is a division of U.S. patent application Ser. No. 12/670,679, filed Jan. 26, 2010, now abandoned which application is a 371 of PCT/JP2007/065090, filed Aug. 1, 2007, the entire contents of which are incorporated herein by reference.

TECHNICAL FIELD

The present invention relates to a rod-like body for ornamental purposes and a method for producing the same, an optimal application of which may be accessories such as a necklace, a bracelet, a hair ornament, a handle of a handbag and other personal effects, a belt, and a strap of camisoles and other undergarments, and the present invention is intended to improve decorativeness by winding a plurality of strap-shaped bodies for ornamental use made of granular ornamental bodies such as jewels, artificial jewels, and beads in a desired number of rows, adhering and securing the strap-shaped bodies using an adhesive layer including a hot-melt adhesive, and retaining the strap-shaped bodies in a wound state and in a shape of a rod so as to obtain variety in aesthetic appearance.

BACKGROUND ART

Conventionally, for example in a case of a necklace, a coated thread reinforced by impregnating the thread with vinyl is used to connect ornamental bodies such as artificial pearls and glass beads. The vinyl-coated thread is hard-twisted by twisting together multiple strings of beads and is passed through the ornamental body so as to produce strong clamping force by a restoring force, and thus the strings of beads are held in a shape of a twisted rope so as to produce decorativeness. Such a necklace with strings of beads is known (for example, see Japanese Patent Application Laid-Open Publication No. S29-10985).

Also, as another conventional invention, a strap body of a noble metal net made by a ball chain made of noble metal as an ornamental body is wound around an outer periphery of the string-shaped or rosary-like content in a longitudinal direction with respect to the outer periphery. At an edge of the strap-shaped strap body, the noble-metallic ball chains are welded together, so that the cylindrical body of the noble metal net is obtained so as to envelope the content and exhibit variety in aesthetic appearance and thereby improve decorativeness. Such an ornamental body is known (for example, see Japanese Patent Application Laid-Open Publication No. 2002-360320).

SUMMARY OF THE INVENTION

Technical Problem

However, in the invention disclosed in the patent literature Japanese Patent Application Laid-Open Publication No. S29-10985, the coated thread obtained by impregnating the through-thread with vinyl is passed through an ornamental body made for example of artificial pearls or glass beads and twisting together a multiple strings of beads, thus the coated thread is strongly twisted so that the strings of beads are retained in the twisted-rope shape by virtue of the clamping force due to the vinyl's restoring force. Accordingly, when an external force acts upon a necklace in an opposite direction resisting the pulling force due to the vinyl's restoring force, multiple strings of beads are not sufficiently secured to each other that are wound in the twisted-rope shape. In such a case, the plurality of strings of beads cannot stay in a twisted-rope shape and may come apart, which decreases and degrades balanced decorativeness having a multiple-sequential structure. Furthermore, when a strong external force acts upon the one end of the coated thread in the direction opposite the vinyl's restoring force, it becomes more difficult for the vinyl to restore in the original state again, so that the vinyl's coated thread may be not sufficiently capable of exerting its clamping force by the restoring force. As a result, the plurality of strings of beads cannot any more retain the shape of the original twisted-rope shape, and the strings of beads may take a strange and loose appearance in terms of aesthetic appearance.

Also, in the invention disclosed in the patent literature Japanese Patent Application Laid-Open Publication No. 2002-360320, a strap body of a noble metal net including a noble-metallic ball chain as an ornamental body is wound around an outer periphery of a string-shaped or rosary-like content in a longitudinal direction with respect to the outer periphery, and the noble-metallic ball chains are welded together at the edge of the strap body so as to envelope the content and form a cylindrical body of the noble metal net, so that in order to weld the noble-metallic ball chains together at the edge of the strap body, much time and labor is required. Furthermore, it is skilled and elaborated work to weld the ball chains together, that requires technical skills, and accordingly it is not easy to produce the products, which led to low production efficiency.

Further, once the noble-metallic ball chains are welded in the above-described manner, mounting positions and mounting directions of the ball chains are subject to constraints, so that the accessory as such also lacks flexibility when mounted.

Also, in the invention disclosed in the patent literature Japanese Patent Application Laid-Open Publication No. 2002-360320, a strap body of the noble metal net made by the ball chain made of noble metal is wound in the longitudinal direction with respect to the outer periphery of the content in a shape of a strand or beads. At the center of the product, strand-shaped element is required, such as raw stones of jewels such as amethyst, quartz crystal, tourmaline, and onyx are connected to each other in a rosary-like manner or clusters of noble metal such as gold alloy, platinum alloy, platinum, and silver are connected in a rosary-like manner, so that thickness of finished accessories such as necklaces and bracelets becomes large, a weight thereof heavy, and a manufacturing cost very high.

Further, in the invention disclosed in the patent literature Japanese Patent Application Laid-Open Publication No. 2002-360320, since the noble-metallic ball chains are welded together at an edge of the strap body of noble metal net made by ball chains made of noble as the ornamental body to envelope the content, it is possible to produce an accessory in which an ornamental body is a noble-metal ball and/or a metal ball that are welded together, but it is not contemplated to produce a cylindrical body that employs an ornamental body not suitable for welding, the body being made for example of a jewel, an artificial jewel, and a bead.

The present invention is intended for solving the problems found in the above conventional inventions. An object of the present invention is to provide an ornamental rod-shaped body and a method for producing the same, which, when a strong external force acts upon the multiple rows of strap-shaped ornamental body that includes an ornamental body that has been wound and bound together, is capable of achieving shape retention with structural robustness in a state of being wound, with high flexibility when being mounted, without the strap-shaped bodies for ornamental use coming apart, by means of which the granular ornamental body can provide luxurious decorativeness with a balanced and multiple-sequential structure. Also, it is possible to manufacture and assemble in a short time and in a simple manner, and with high manufacturing efficiency, and furthermore, manufacturing and assembling may be performed even when the granular ornamental body is made of non-metal material other than the noble metal and metal, the non-metal material being a jewel, an artificial jewel, and a bead with wide range of application. Also, with respect to the thickness of the finished product, both thin product and thick product can be manufactured and it can be more light-weighted and further the manufacturing costs can be decreased.

Solution to Problem

According to a first aspect of the present invention, there is provided an ornamental rod-like body that includes a strap-shaped ornamental body that includes: a plurality of granular ornamental bodies selected from the group consisting of a jewel, an artificial jewel, a bead, a noble-metal ball, and a metal ball; a connecting member configured to arrange the granular ornamental bodies in a plurality of rows and connect the granular ornamental bodies to each other; and an adhesion member having an adhesive layer including a hot-melt adhesive, the adhesion member being configured to be adhered to a backside of the connecting member, the strap-shaped ornamental body being adhered and secured to the adhesion member such that the strap-shaped ornamental body is wound around the adhesion member with the granular ornamental bodies exposed radially outward of the adhesion member.

Also, the invention according to a second aspect of the present invention is an ornamental rod-like body that includes a strap-shaped ornamental body that includes: a plurality of granular ornamental bodies selected from the group consisting of a jewel, an artificial jewel, a bead, a noble-metal ball, and a metal ball; a connecting member configured to arrange the granular ornamental bodies in a plurality of rows and connect the granular ornamental bodies to each other; an adhesion member having on both sides thereof an adhesive layer including a hot-melt adhesive, the adhesion member being configured to be provided on a backside of the connecting member; and a reinforcing core around which the adhesion member is wound, the strap-shaped ornamental body being adhered and secured to the reinforcing core via the adhesive layer such that the strap-shaped ornamental body is wound around the reinforcement fore around which the adhesion member has been wound with the granular ornamental bodies exposed radially outward of the reinforcing core.

Also, the invention according to a third aspect of the present invention is the ornamental rod-like body according to the first or second aspect, wherein the connecting member includes: an attachment ring including a loop arm in a shape of a cross in a plan view or in a Y-shape in the plan view, the loop arm being provided on one side of the attachment ring and an attaching portion provided on an other side of the attachment ring opposed to the loop arm, an internal dimension of the attaching portion corresponding to a portion of the granular ornamental body at which the granular ornamental body is attached to the attachment ring; and a connecting ring configured to be inserted into the loop arm of the attaching ring so as to bind together on one plane the granular ornamental bodies that each have been attached to a plurality of the attachment rings such that the granular ornamental bodies are connected to each other in a desired number of rows on a desired plane.

Also, the invention according to a fourth aspect of the present invention is the ornamental rod-like body according to the first or third aspect, wherein a plurality of the strap-shaped ornamental bodies are adhered to the adhesive layer and bound together so as to be twisted around and secured to the linearly extending adhesion member.

Also, the invention according to a fifth aspect of the present invention is the ornamental rod-like body according to the second or third aspects, wherein a plurality of the strap-shaped ornamental bodies are bound together, twisted around and secured to the reinforcing core, the strap-shaped ornamental bodies being adhered to the reinforcing core either via the adhesion member wound around the reinforcing core spirally or via a hot-melt adhesive tape wound around an outer periphery of the adhesion member that has been wound around the reinforcing core spirally.

Also, according to a sixth aspect of the present invention, provided is a method for producing an ornamental rod-like body that includes the steps in the sequence set forth: (a) arranging and connecting granular ornamental bodies in a plurality of rows via a connecting member so as to obtain a strap-shaped ornamental body, the granular ornamental bodies being selected from the group consisting of a jewel, an artificial jewel, a bead, a noble-metal ball, and a metal ball; (b) winding the obtained strap-shaped ornamental body spirally around a linearly extending adhesion member having an adhesive layer including a hot-melt adhesive, with the granular ornamental bodies exposed radially outward of the adhesion member; and (c) moving a heating unit relative to the strap-shaped ornamental body wound around the adhesion member in a longitudinal direction thereof, heating the hot-melt adhesive to melt the hot-melt adhesive, cooling the hot-melt adhesive that has been melted, and retaining the strap-shaped ornamental body in a shape of a rod.

Also, the invention according to a seventh aspect of the present invention, there is provided a method for producing an ornamental rod-like body including the steps in the sequence set forth: arranging granular ornamental bodies in a plurality of rows and connecting the granular ornamental bodies via a connecting member to obtain a strap-shaped ornamental body, the granular ornamental bodies being selected from the group consisting of a jewel, an artificial jewel, a bead, a noble-metal ball, and a metal ball; either winding an adhesion member around an outer periphery of a strand-shaped reinforcing core spirally, the adhesion member having on both sides thereof an adhesive layer including a hot-melt adhesive, or further winding hot-melt adhesive tape spirally around an outer periphery of the adhesion member that has been wound around the outer periphery of the strand-shaped reinforcing core; winding the obtained strap-shaped ornamental body spirally around either the outer periphery of the adhesion member or the outer periphery of the hot-melt adhesive tape with the granular ornamental bodies exposed radially outward of the strand-shaped reinforcing core; and moving a heating unit relative to either the strap-shaped ornamental body and the adhesion member, or the strap-shaped ornamental body, the adhesion member, and the hot-melt adhesive tape relative to a heating unit in a longitudinal direction, heating the hot-melt adhesive to melt the hot-melt adhesive, cooling the melted hot-melt adhesive, and retaining the strap-shaped ornamental body in a shape of a rod.

Also, the invention according to an eighth aspect of the present invention is a method for producing an ornamental rod-like body including the following steps in the sequence set forth: (a) arranging in a plurality of rows and connecting granular ornamental bodies via a connecting member to form a strap-shaped ornamental body, the granular ornamental bodies being selected from the group consisting of a jewel, an artificial jewel, a bead, a noble-metal ball, and a metal ball; (b) either winding an adhesion member having on both sides thereof an adhesive layer including a hot-melt adhesive spirally around an outer periphery of the strand-shaped reinforcing core, or further winding hot-melt adhesive tape spirally around an outer periphery of the adhesion member that has been wound around the outer periphery of the strand-shaped reinforcing core; (c) winding the strap-shaped ornamental body spirally around either the outer periphery of the adhesion member or the outer periphery of the hot-melt adhesive tape such that the granular ornamental body is exposed to the outer periphery; (d) relatively moving the strap-shaped ornamental body and the adhesion member, or the strap-shaped ornamental body, the adhesion member, and the hot-melt adhesive tape with respect to the heating unit in the longitudinal direction, heating and melting the hot-melt adhesive, (e) applying pressing by pressing unit upon the strap-shaped ornamental body to adjust position of adhesion of the adhesion member with respect to the reinforcing core and adhesion pressure applied to the adhesion member, and adjusting the position of adhesion of the strap-Shaped ornamental body with respect to the adhesion member and adhesion pressure of the strap-shaped ornamental body, and cooling the hot-melt adhesive that has been melted to retain the strap-shaped ornamental body in a shape of a rod.

Further, the invention according to a ninth aspect of the present invention is the method for producing the ornamental rod-like body according to any of sixth to eighth aspects, wherein the heating unit is either a drier or a heater.

Advantageous Effects of the Invention

According to the first aspect of the present invention, the ornamental rod-like body includes the strap-Shaped ornamental body that includes: the plurality of granular ornamental bodies selected from the group consisting of a jewel, an artificial jewel, a bead, a noble-metal ball, and a metal ball; the connecting member configured to arrange the granular ornamental bodies in the plurality of rows and connect the granular ornamental bodies to each other; and the adhesion member having the adhesive layer including the hot-melt adhesive, the adhesion member being configured to be adhered to the backside of the connecting member, the strap-shaped ornamental body being adhered and secured to the adhesion member such that the strap-shaped ornamental body is wound around the adhesion member with the granular ornamental bodies exposed radially outward of the adhesion member. Accordingly, when a strong external force acts upon the multiple rows of strap-shaped ornamental body that includes the ornamental body that has been wound and bound together, strap-shaped ornamental body, the invention is capable of achieving shape retention with structural robustness in a state of being wound, with high flexibility when being mounted, without the strap-shaped bodies for ornamental use coming apart, by means of which the granular ornamental bodies can provide luxurious decorativeness with a balanced and multiple-sequential structure. Also, it is possible to manufacture and assemble the ornamental rod-like body in a short time and in a simple manner, and with high manufacturing efficiency, and furthermore, manufacturing and assembling of the ornamental rod-like body may be performed even when the granular ornamental bodies are made of non-metal material other than the noble metal and metal materials, the non-metal material being a jewel, an artificial jewel, and a bead, providing wide range of application. Also, with respect to the thickness of the finished product, both thin product and thick product can be manufactured and the products can be more light-weighted and the manufacturing costs can be reduced.

Also, according to the second aspect of the present invention, the ornamental rod-like body comprising the strap-shaped ornamental body that includes: the plurality of granular ornamental bodies selected from the group consisting of a jewel, an artificial jewel, a bead, a noble-metal ball, and a metal ball; the connecting member configured to arrange the granular ornamental bodies in the plurality of rows and connect the granular ornamental bodies to each other; the adhesion member having on both sides thereof the adhesive layer including the hot-melt adhesive, the adhesion member being configured to be provided on the backside of the connecting member; and the reinforcing core around which the adhesion member is wound, the strap-shaped ornamental body being adhered and secured to the reinforcing core via the adhesive layer such that the strap-shaped ornamental body is wound around the reinforcement fore around which the adhesion member has been wound with the granular ornamental bodies exposed radially outward of the reinforcing core. Accordingly, when a strong external force acts upon the multiple rows of strap-shaped ornamental body that includes the ornamental bodies that have been wound and bound together, the invention is capable of achieving shape retention with structural robustness in a state of being wound, with high flexibility when being mounted, without the strap-shaped bodies for ornamental use coming apart, by means of which the granular ornamental bodies can provide luxurious decorativeness with a balanced and multiple-sequential structure. Also, it is possible to manufacture and assemble the ornamental rod-like body in a short time in a simple manner, and with high manufacturing efficiency, and furthermore, manufacturing and assembling of the ornamental rod-like body may be performed even when the granular ornamental bodies are made of non-metal material other than the noble metal and metal, the non-metal material being a jewel, an artificial jewel, and a bead, providing a wider range of application. Also, with respect to the thickness of the finished product, both thin product and thick product can be manufactured and the products can be more light-weighted and the manufacturing costs can be reduced.

Also, according to the third aspect of the present invention, in the ornamental rod-like body according to the first or second aspect, the connecting member includes: the attachment ring including the loop arm in the shape of the cross in the plan view or in the Y-shape in the plan view, the loop arm being provided on one side of the attachment ring and the attaching portion provided on the other side of the attachment ring opposed to the loop arm, the internal dimension of the attaching portion corresponding to the portion of the granular ornamental body at which the granular ornamental body is attached to the attachment ring; and the connecting ring configured to be inserted into the loop arm of the attaching ring so as to bind together on one plane the granular ornamental bodies that each have been attached to a plurality of the attachment rings such that the granular ornamental bodies are connected to each other in the desired number of rows on the desired plane. Accordingly, when the desired number of rows of the strap-shaped ornamental bodies are wound in the longitudinal direction, multiple attachment rings can be attached to the connecting ring residing at the centre of the attachment rings through simplified operation in the mounting direction and the mounting angle with respect to an environment. Accordingly, while the strap-shaped ornamental body is wound in the longitudinal direction and thereby the hot-melt adhesive of the adhesion member is cooled and solidified, each row of the granular ornamental body to be wound is fine-tuned with respect to the mounting direction and the mounting angle so as to be arranged in a radial direction about the axis and in the same orientation and there is left no irregularity. Thus, the granular ornamental bodies can exhibit higher luminance allowing more excellent decorativeness.

Also, according to the fourth aspect of the present invention, in the ornamental rod-like body according to the first or third aspect, the plurality of the strap-shaped ornamental bodies are adhered to the adhesive layer and bound together so as to be twisted around and secured to the linearly extending adhesion member. Accordingly, since the strap-shaped ornamental body is wound about the linearly-extending adhesion member, the strap-shaped ornamental body is protected from being disconnected due to an external force such as pulling and twisting so as to obtain further structural robustness.

Also, according to the fifth aspect of the present invention, in the ornamental rod-like body according to the second or third aspect, the plurality of the strap-shaped ornamental bodies are bound together, twisted around and secured to the reinforcing core, the strap-shaped ornamental bodies being adhered to the reinforcing core either via the adhesion member wound around the reinforcing core spirally or via the hot-melt adhesive tape wound around the outer periphery of the adhesion member that has been wound around the reinforcing core spirally. Accordingly, since the strap-shaped ornamental body is wound around the outer periphery of the adhesion member about the reinforcing core, the strap-shaped ornamental body is protected from being disconnected due to an external force such as pulling and twisting so as to obtain further structural robustness.

Also, according to the sixth aspect of the present invention, the method for producing an ornamental rod-like body includes the steps in the sequence set forth: arranging and connecting the granular ornamental bodies in the plurality of rows via the connecting member so as to obtain the strap-shaped ornamental body, the granular ornamental bodies being selected from the group consisting of a jewel, an artificial jewel, a head, a noble-metal ball, and a metal ball; winding the obtained strap-shaped ornamental body spirally around the linearly extending adhesion member having the adhesive layer including the hot-melt adhesive, with the granular ornamental bodies exposed radially outward of the adhesion member; and moving the heating unit relative to the strap-shaped ornamental body wound around the adhesion member in the longitudinal direction thereof, heating the hot-melt adhesive to melt the hot-melt adhesive, cooling the hot-melt adhesive that has been melted, and retaining the strap-shaped ornamental body in the shape of the rod. Accordingly, when a strong external force acts upon the multiple rows of strap-shaped ornamental bodies that include the strap-shaped ornamental bodies that have been wound and bound together, the invention is capable of achieving good shape retention with structural robustness in the state of being wound, with high flexibility when being mounted, without the strap-shaped bodies for ornamental use coming apart, by means of which the granular ornamental bodies can provide luxurious decorativeness with a balanced and multiple-sequential structure. Also, it is possible to manufacture and assemble the ornamental rod-like body in a short time and in a simple manner, and with high manufacturing efficiency, and furthermore, manufacturing and assembling of the ornamental rod-like body may be performed even when the granular ornamental bodies are made of non-metal material other than the noble metal and metal materials, the non-metal material being a jewel, an artificial jewel, and a bead, providing a wider range of application. Also, with respect to the thickness of the finished product, both thin product and thick product can be manufactured and the products can be more light-weighted and the manufacturing costs can be reduced.

Also, according to the seventh aspect of the present invention, the method for producing the ornamental rod-like body includes the steps in the sequence set forth: arranging granular ornamental bodies in a plurality of rows and connecting the granular ornamental bodies via a connecting member to obtain a strap-shaped ornamental body, the granular ornamental bodies being selected from the group consisting of a jewel, an artificial jewel, a bead, a noble-metal ball, and a metal ball; either winding an adhesion member around an outer periphery of a strand-shaped reinforcing core spirally, the adhesion member having on both sides thereof an adhesive layer including a hot-melt adhesive, or further winding hot-melt adhesive tape spirally around an outer periphery of the adhesion member that has been wound around the outer periphery of the strand-shaped reinforcing core; winding the obtained strap-shaped ornamental body spirally around either the outer periphery of the adhesion member or the outer periphery of the hot-melt adhesive tape with the granular ornamental bodies exposed radially outward of the strand-shaped reinforcing core; and moving a heating unit relative to either the strap-shaped ornamental body and the adhesion member, or the strap-shaped ornamental body, the adhesion member, and the hot-melt adhesive tape relative to a heating unit in a longitudinal direction, heating the hot-melt adhesive to melt the hot-melt adhesive, cooling the melted hot-melt adhesive, and retaining the strap-shaped ornamental body in a shape of a rod. Accordingly, when a strong external force acts upon the multiple rows of strap-shaped ornamental bodies that includes the strap-shaped ornamental bodies that have been wound and bound together, the invention is capable of achieving good shape retention with structural robustness in the state of being wound, with high flexibility when being mounted, without the strap-shaped bodies for ornamental use coming apart, by means of which the granular ornamental bodies can provide luxurious decorativeness with the balanced and multiple-sequential structure. Also, it is possible to manufacture and assemble the ornamental rod-like body in a short time and in a simple manner, and with high manufacturing efficiency, and furthermore, manufacturing and assembling of the ornamental rod-like body may be performed even when the granular ornamental bodies are made of non-metal material other than the noble metal and metal materials, the non-metal material being a jewel, an artificial jewel, and a bead with wide range of application. Also, with respect to the thickness of the finished product, both thin product and thick product can be manufactured and the products can be more light-weighted and the manufacturing costs can be reduced.

Also, according to the eighth aspect of the present invention, the method for producing the ornamental rod-like body includes the steps as set forth: arranging in a plurality of rows and connecting granular ornamental bodies via a connecting member to form a strap-shaped ornamental body, the granular ornamental bodies being selected from the group consisting of a jewel, an artificial jewel, a bead, a noble-metal ball, and a metal ball; either winding an adhesion member having on both sides thereof an adhesive layer including a hot-melt adhesive spirally around an outer periphery of the strand-shaped reinforcing core, or further winding hot-melt adhesive tape spirally around an outer periphery of the adhesion member that has been wound around the outer periphery of the strand-shaped reinforcing core; winding the strap-shaped ornamental body spirally around either the outer periphery of the adhesion member or the outer periphery of the hot-melt adhesive tape such that the granular ornamental body is exposed to the outer periphery; relatively moving the strap-shaped ornamental body and the adhesion member, or the strap-shaped ornamental body, the adhesion member, and the hot-melt adhesive tape with respect to the heating unit in the longitudinal direction, heating and melting the hot-melt adhesive, applying pressing by pressing unit upon the strap-shaped ornamental body to adjust position of adhesion of the adhesion member with respect to the reinforcing core and adhesion pressure applied to the adhesion member, and adjusting the position of adhesion of the strap-shaped ornamental body with respect to the adhesion member and adhesion pressure of the strap-shaped ornamental body, and cooling the hot-melt adhesive that has been melted to retain the strap-shaped ornamental body in a shape of a rod. Accordingly, when the strong external force acts upon the multiple rows of the strap-shaped ornamental bodies that include the strap-shaped ornamental bodies that have been wound and bound together, the invention is capable of achieving good shape retention with structural robustness in the state of being wound, with high flexibility when being mounted, without the strap-shaped bodies for ornamental use coming apart, by means of which the granular ornamental bodies can provide luxurious decorativeness with the balanced and multiple-sequential structure. Also, it is possible to manufacture and assemble the ornamental rod-like body in a short time and in a simple manner, and with high manufacturing efficiency, and furthermore, manufacturing and assembling of the ornamental rod-like body may be performed even when the granular ornamental bodies are made of non-metal material other than the noble metal and metal materials, the non-metal material being a jewel, an artificial jewel, and a bead with wide range of application. Also, with respect to the thickness of the finished product, both thin product and thick product can be manufactured and the products can be more light-weighted and the manufacturing costs can be reduced.

Further, according to the ninth aspect of the present invention, in the method for producing the ornamental rod-like body according to any of sixth to eighth aspects, the heating unit is either the drier or the heater. Accordingly, through relative movement of the heating unit with respect to the strap-shaped ornamental body and the adhesion member in the axial direction, the hot-melt adhesive of the adhesion member is heated and melted by virtue of the heat generated by the heating unit, so that the strap-shaped ornamental body is retained in a shape of a rod such that the strap-shaped ornamental bodies are bound together, wound around the reinforcing core, adhered and secured to the reinforcing core with the granular ornamental bodies of the strap-shaped ornamental body exposed radially outward of the reinforcing core.

DESCRIPTION OF THE EMBODIMENT

The following describes a preferred embodiment of the present invention along with a device for which the present invention is used with reference to the attached drawings.

First Embodiment

Figure 1:
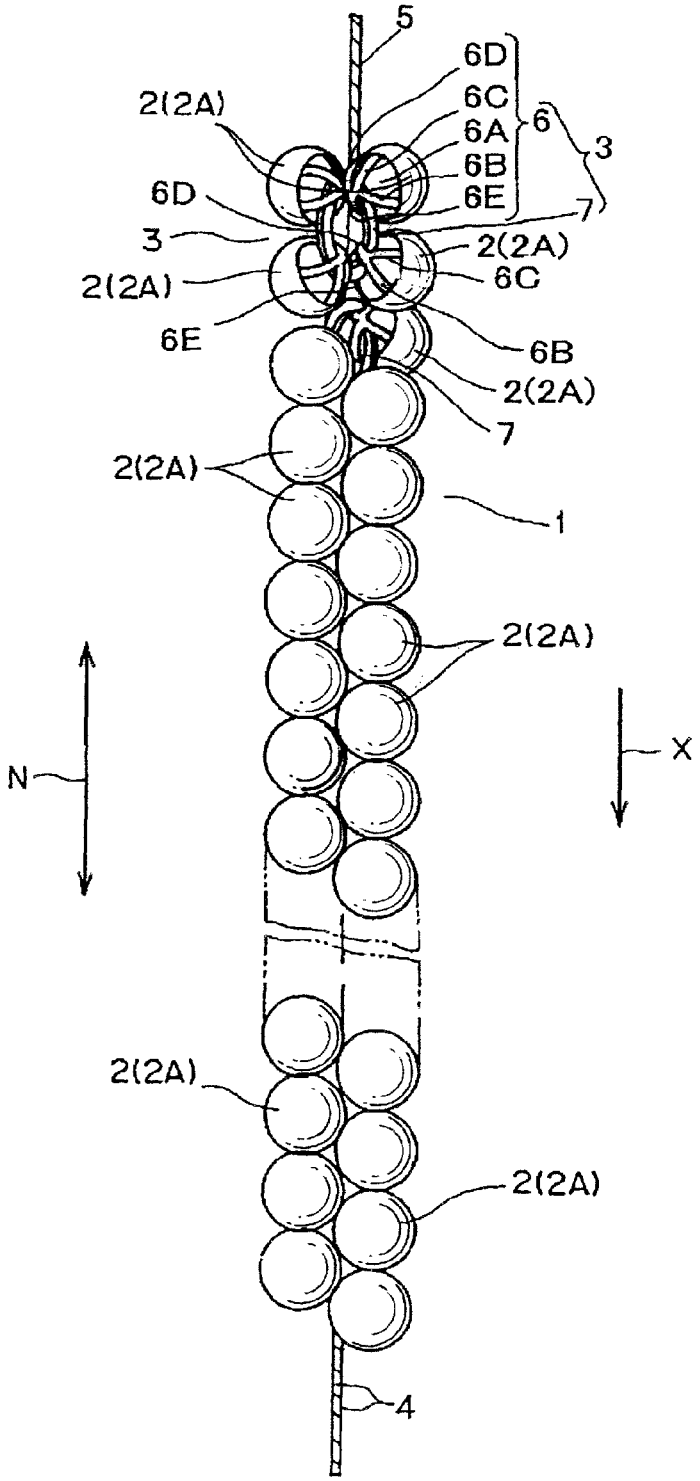
FIG. 1 is an enlarged perspective view illustrating an ornamental rod-like body according to a first embodiment of the present invention.
Figure 2:
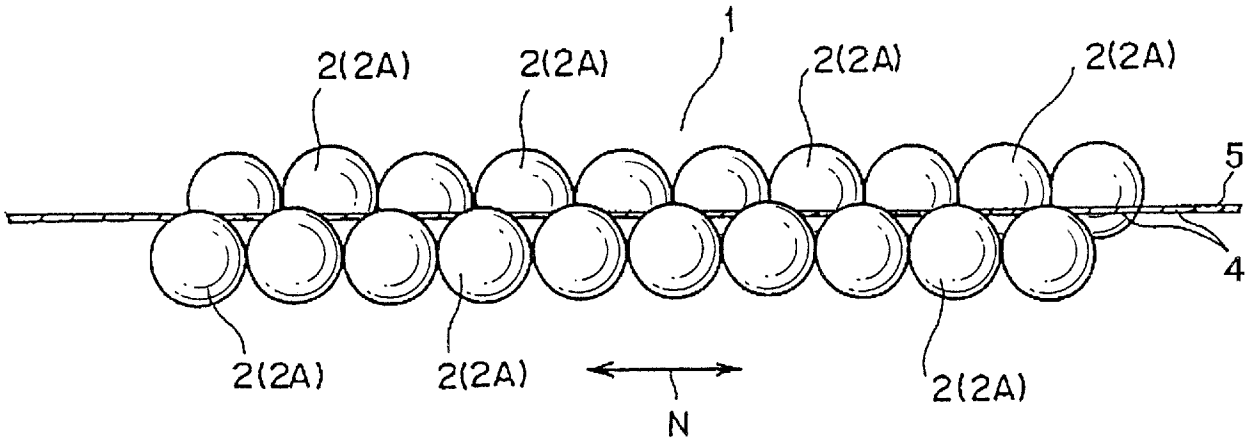
FIG. 2 is an enlarged front view of the ornamental rod-like body according to the first embodiment of the present invention.
Figure 3:
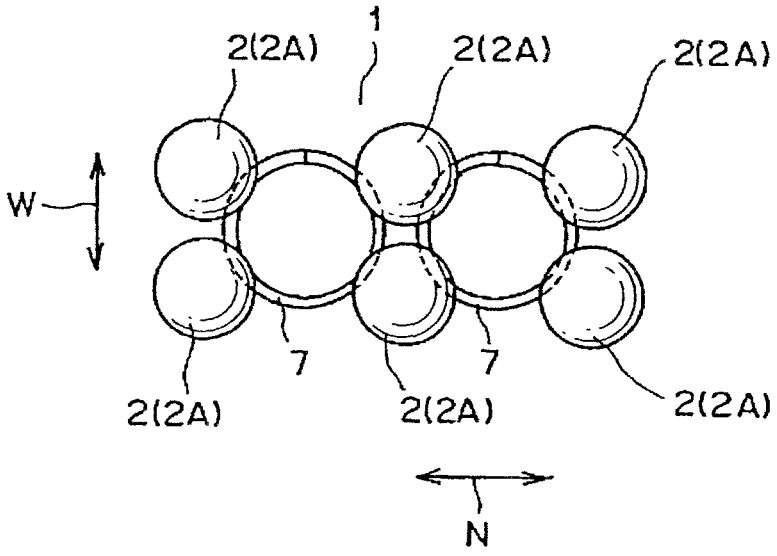
FIG. 3 is an enlarged plan view of strap-shaped ornamental body according to the first embodiment of the present invention, the strap-shaped body being obtained by connecting granular ornamental bodies by a connecting member.
Figure 4:
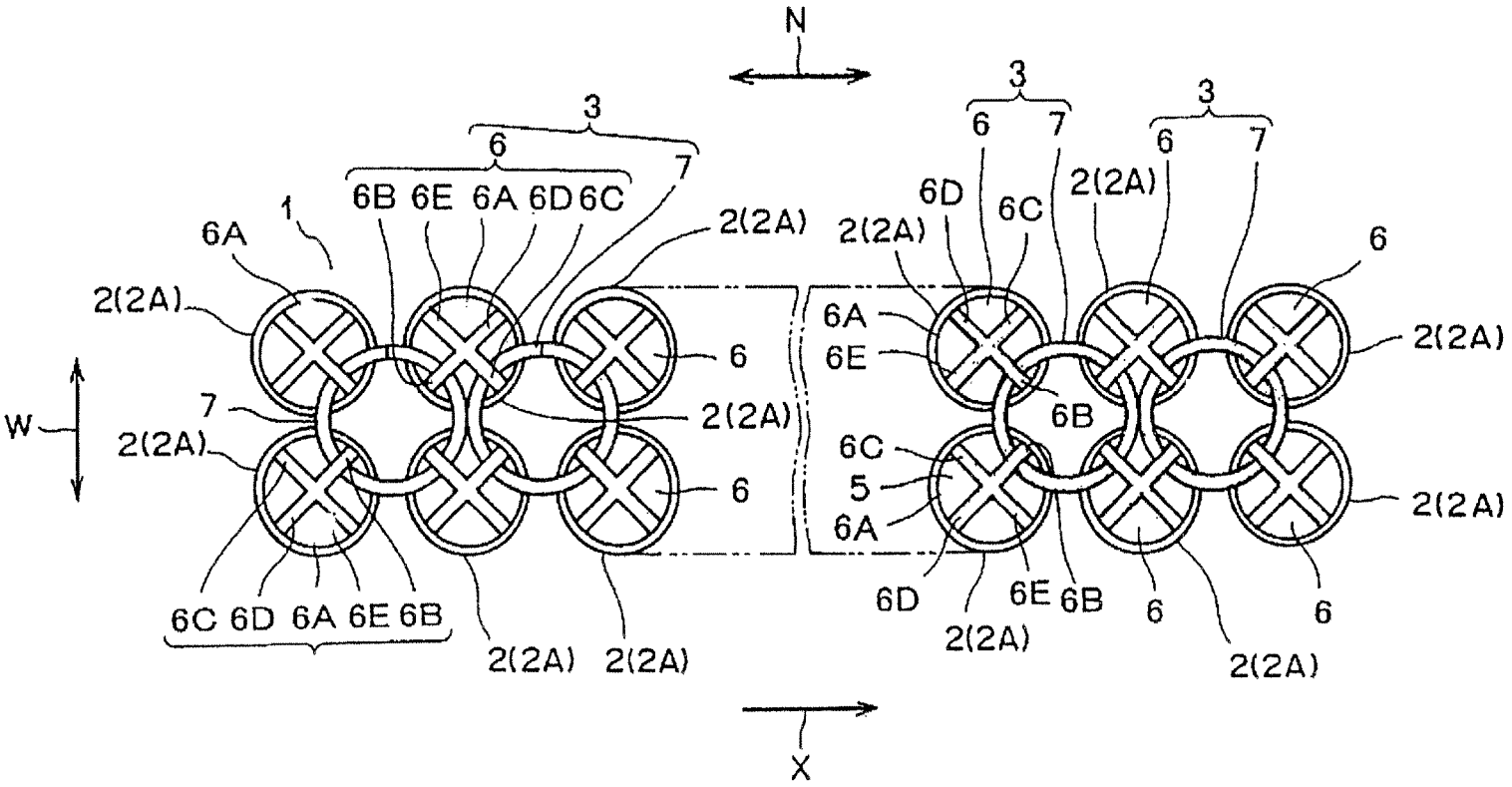
FIG. 4 is an enlarged rear-face view illustrating the strap-shaped ornamental body according to the first embodiment of the present invention.
Figure 5:
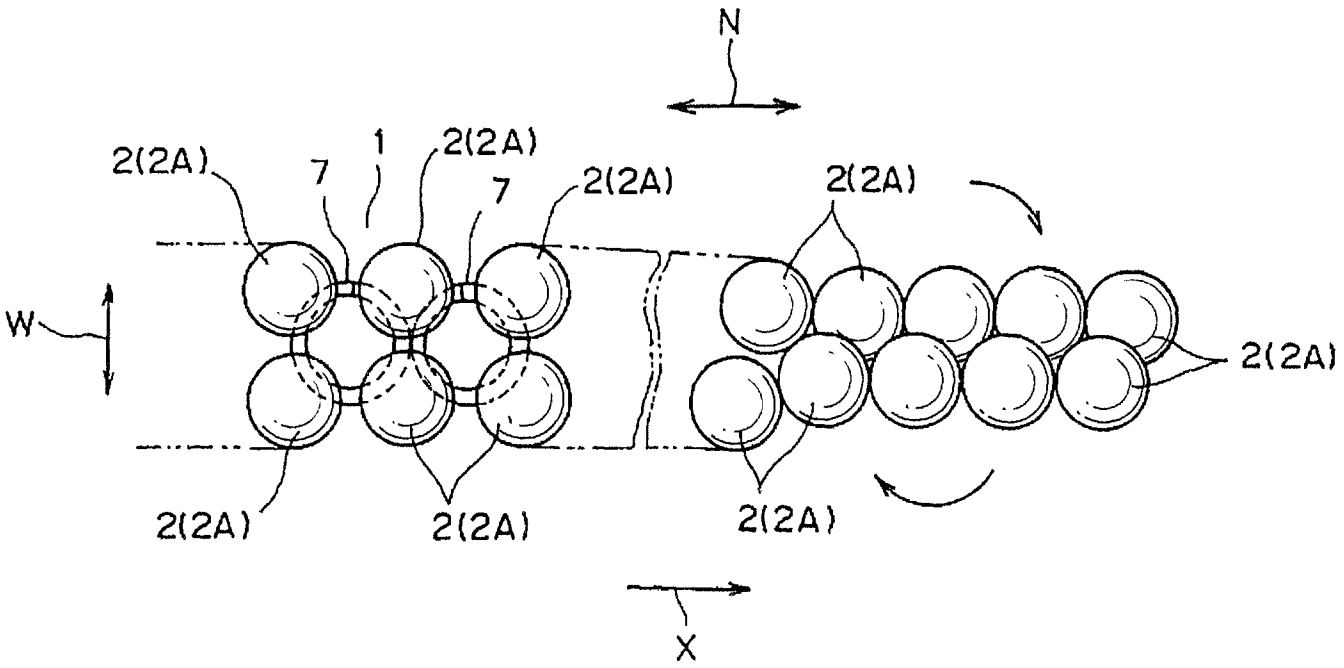
FIG. 5 is a plan view illustrating the strap-shaped ornamental body that is being wound.
Figure 6:
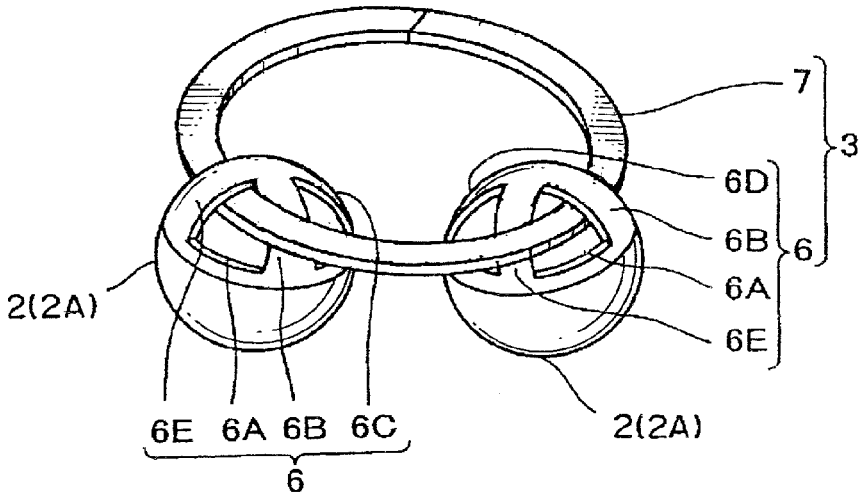
FIG. 6 is an enlarged perspective view illustrating the connecting member of the strap-shaped ornamental body according to the first embodiment of the present invention.
Figure 7:
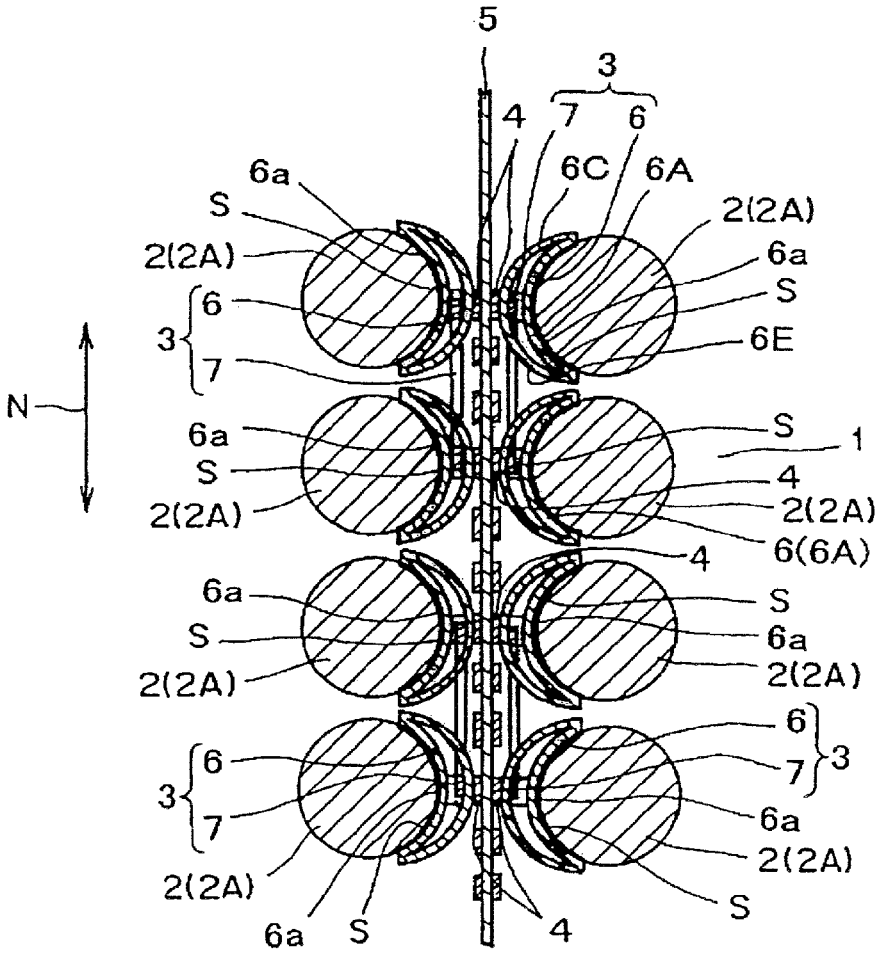
FIG. 7 is an enlarged cross-sectional view illustrating the strap-shaped ornamental body of the first embodiment that is wound and bonded by an adhesive layer which includes a hot-melt adhesive.
Figure 8:
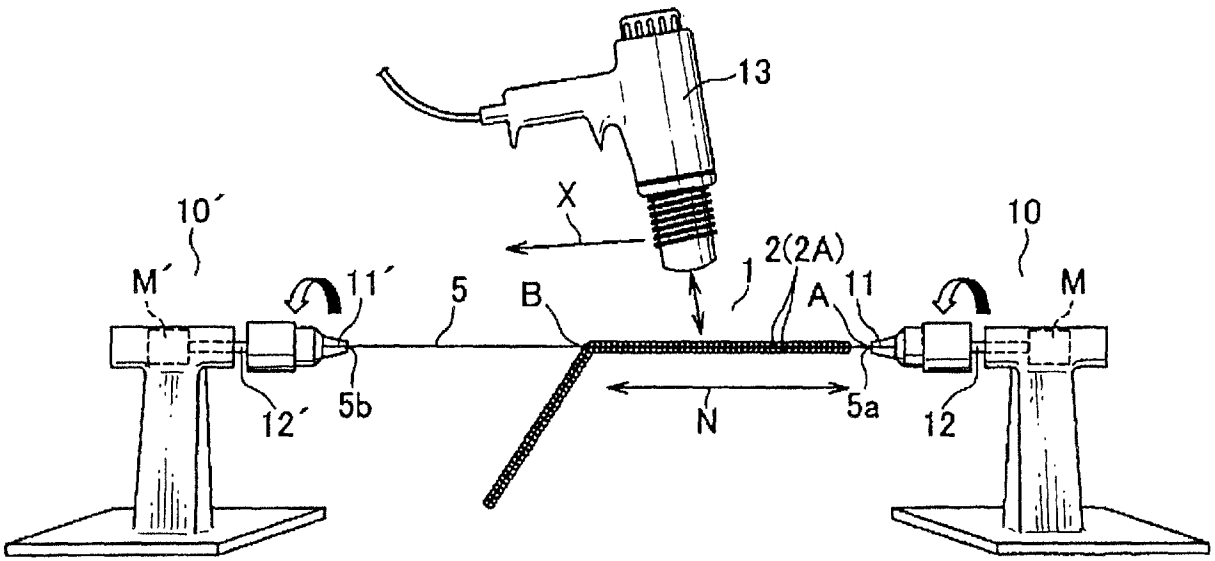
FIG. 8 is a perspective view illustrating steps of a method for producing the manufacturing ornamental rod-like body of the first embodiment of the present invention.
Figure 9:
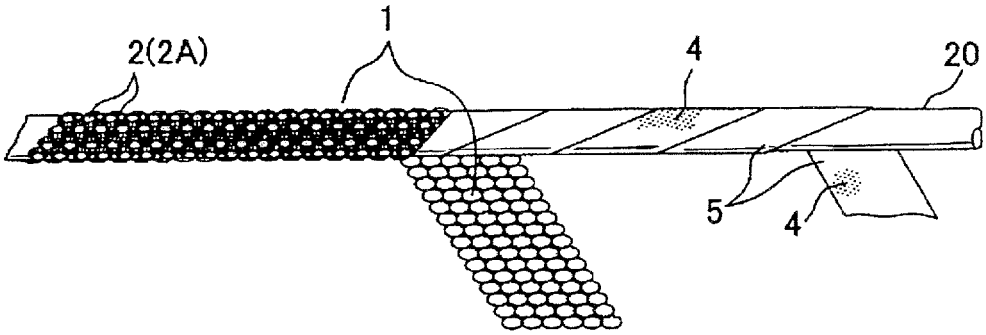
FIG. 9 is an explanatory perspective view illustrating an ornamental rod-like body according to a second embodiment of the present invention.
Figure 10:
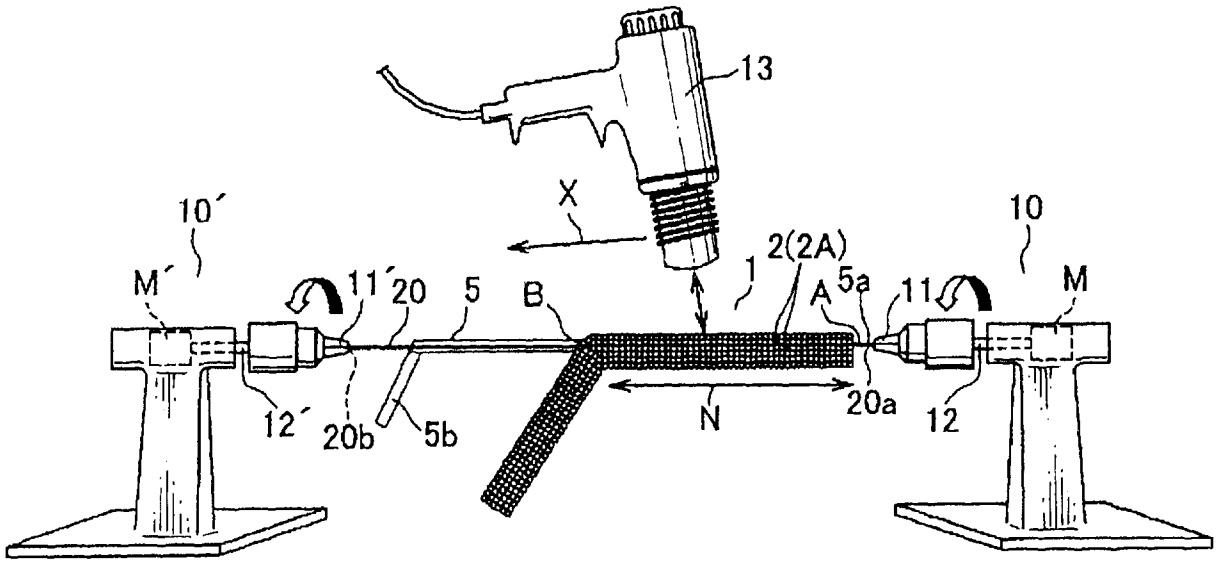
FIG. 10 is a perspective view illustrating the steps of the method for producing the ornamental rod-like body according to the second embodiment of the present invention.

FIG. 1 is an enlarged perspective view illustrating an ornamental rod-like body according to a first embodiment of the present invention. FIG. 2 is an enlarged front view of the ornamental rod-like body according to the first embodiment of the present invention. FIG. 3 is an enlarged plan view of strap-shaped ornamental body according to the first embodiment of the present invention, the strap-shaped body being obtained by connecting granular ornamental bodies by a connecting member. FIG. 4 is an enlarged rear-face view illustrating the strap-shaped ornamental body according to the first embodiment of the present invention. FIG. 5 is a plan view illustrating the strap-shaped ornamental body which is being wound. FIG. 6 is an enlarged perspective view illustrating the connecting member of the strap-shaped ornamental body according to the first embodiment of the present invention. FIG. 7 is an enlarged cross-sectional view illustrating the strap-shaped ornamental body of the first embodiment that is wound and bonded by an adhesive layer which includes a hot-melt adhesive. FIG. 8 is a perspective view illustrating steps of a method for producing the manufacturing ornamental rod-like body of the first embodiment of the present invention.

The ornamental rod-like body of the first embodiment of the present invention includes a strap-shaped ornamental body 1 for ornamental purposes (hereafter simply called the "strap-shaped ornamental body 1") that includes: granular ornamental bodies 2 selected from among a jewel, an artificial jewel 2A, a bead, a noble-metal ball, and a metal ball; a connecting member 3 configured to arrange the granular ornamental bodies 2 in a plurality of rows and connect the granular ornamental bodies 2 to each other; and a adhesion member 5 adapted to be adhered to a reverse side of the connecting member 3, the adhesion member 5 including a adhesive layer 4 made of hot-melt adhesive. The strap-shaped ornamental body 1 is wound around the adhesion member 5 and adhered to the adhesion member 5 such that the granular ornamental bodies are exposed radially outward of the adhesion member 5.

In the shown first embodiment, each row of the granular ornamental bodies 2 of the strap-shaped ornamental body 1, which are connected via the connecting member 3 is constituted by the granular ornamental bodies 2 having a substantially same diameter and a single color including white, milky white, red, green, blue, yellow, orange. The granular ornamental bodies 2 may have different sizes and colors depending upon the rows to which the granular ornamental bodies 2 belong. Also, the colors of granular ornamental bodies 2 may vary sequentially within the rows to which the granular ornamental bodies 2 belong so as to exhibit variety in aesthetic appearance.

Also, the jewel may include diamond, emerald, sapphire, ruby, opal, jade, amethyst, quartz crystal, tourmaline, onyx, coral, and pearl. The noble-metal ball may include gold, gold alloy, platinum, white gold alloy, and silver. The metal ball may include iron, stainless steel, copper, aluminum, and zinc.

The adhesion member 5 includes a ribbon-shaped base material and an adhesive layer 4 provided for example on an upper surface of the base material. In the first embodiment, the base material may include a natural fibrous material and a synthetic fiber material. Width and length of the base material may be approximately nine (9) millimeters and dozens of meters, respectively. The base material may have striped texture and may be compressed. A film of synthetic resin may be used. The adhesive layer 4 is provided for example around the upper surface of the base material that takes a linear shape layer 4 is made of hot-melt adhesive. The strap-shaped ornamental body 1 is constituted by a desired number of rows granular ornamental bodies 2, for example two rows in the shown first embodiment. The two rows of the granular ornamental bodies 2 are wound around the linear-shaped adhesion member 5 and bound together about the adhesion member 5 via its adhesive layer 4. In this manner, the two rows of the granular ornamental bodies 2 are adhered and fixed.

Referring to FIG. 8, there are shown a first supporting platform 10 and a second supporting platform 10'. The first supporting platform 10 is used to twist the ribbon-shaped adhesion member 5 into a linear shape. In order to hold the adhesion member 5, the first supporting platform 10 may clamp one end 5*a* of the adhesion member 5 by a chuck mechanism 11 provided at an end of a rotation axis 12 driven by a motor M. Alternatively, although not shown. The end of the rotation axis 12 may be connected to the one end 5*a* of the adhesion member 5. In this manner, the one end 5*a* of the adhesion member 5 is secured. After that, the one end 5*a* of the adhesion member 5 is turned clockwise or counter clockwise to straighten the ribbon-shaped adhesion member 5 into the linear shape. The hot-melt adhesive layer 4 of the adhesion member 5 is exposed radially outward with respect to the adhesion member 5. The second supporting platform 10 has the same configuration as that of the first supporting platform 10. The second supporting platform 10' includes a chuck mechanism 11' provided at an end of a rotation axis 12' driven by a motor M'. The chuck mechanism 10' is adapted to clamp the end 5*b* of the adhesion member 5. The first supporting platform 10 may be adapted to perform winding operation and adhesion-fixation operation. For example, in the winding operation, the first supporting platform 10, in cooperation with the second supporting platform 10', winds the granular ornamental bodies 2 of the strap-shaped ornamental body 1 spirally around the adhesion member 5 that has been clamped and straightened in the linear shape by these two platforms 10, 10'. In the adhesion-fixation operation, the first supporting platform 10 in cooperation with the second supporting platform 10' may heat and melt the hot-melt adhesive layer 4 of the adhesion member 5 by means of a heating unit 13, makes the granular ornamental bodies 2 of the strap-shaped ornamental body 1 adhered and fixed together via the adhesion member 5 such that the granular ornamental bodies 2 are exposed radially outward of the adhesion member 5.

Referring to FIGS. 4, 6, and 7, the connecting member 3 of the first embodiment includes an attachment ring 6 and a connecting ring 7. As shown in these figures, the attachment ring 6 includes an attaching portion 6A. The attaching portion 6A is configured to attach artificial jewels 2A (that corresponds to the granular ornamental bodies 2) on a front side thereof. The attaching portion 6A includes four loop arms 6B, 6C, 6D, and 6E. The loop arms 6B, 6C, 6D, and 6E are provided in a shape of a cross in a plan view on an upper side of the attaching portion 6A. The connecting ring 7 is inserted into the loop arms 6B, 6C, 6D, and 6E and bundle the granular ornamental bodies 2 attached to the attachment ring 6 together on a reverse side thereof. In the first embodiment, by virtue of the connecting member 3, the granular ornamental bodies 2 are bound together in a desired number of rows on a desired plane (in the first embodiment 1, two rows in a width direction W and a desired length of the strap-shaped ornamental body 1 in a longitudinal direction N). An adhesive S may be employed to attach the artificial jewel 2A to the front side of the attachment ring 6 (see FIG. 7).

Also, the connecting ring 7 shown in the figures has a shape of a ring, nevertheless the outer shape may take other shapes, although not shown, for example, triangular, tetragonal, pentagonal, and hexagonal shapes at discretion insofar as it is in shape of a ring having an end.

The hot-melt adhesive of the adhesive layer 4 may be an adhesive made of polystyrene or polyamide resin, a copolymer such as ABS resin and SAN resin, or other adhesives made of synthetic resin capable of reversibly softened under supply of heat, such as polyacetal, polycarbonate, and polyester. Also, the amount of application of the hot-melt adhesive is determined depending upon a size of the attachment ring 6 to which the granular ornamental bodies 2 are attached, the number of the granular ornamental bodies 2 that are twisted together to constitute the strap-shaped ornamental body 1, a melting temperature of the hot-melt adhesive, a relative speed of the strap-shaped ornamental body 1 with respect to the heating unit 13 so that an optimum amount of application is obtained.

The heating unit 13 may include a drier or a heater. Referring to FIG. 8, the heating unit 13 is relatively displaced with respect to the strap-shaped ornamental body 1 that includes desired rows of granular ornamental bodies 2 in the longitudinal direction N. By relatively moving the heating unit 13, the hot-melt adhesive of the adhesive layer 4 that is exposed radially outward of the twisted and linear adhesion member 5 is heated and melted so that the strap-shaped ornamental body 1 is adhered and fixed to constitute the ornamental rod-like body.

The adhesive S used to attach the artificial jewels 2A (granular ornamental bodies 2) to the attaching portion 6A of the attachment ring 6 may be made of phenoplast, aminoplast, epoxy resin, acrylic resin, alkyd resin, and unsaturated polyester resin or any other preferable material having a suitable thermal stability.

While the ornamental rod-like body of the present invention may include a desired number of rows of the granular ornamental bodies 2, which corresponds to the artificial jewels 2A and are connected via the connecting member 3, the ornamental rod-like body of the first embodiment specifically includes the strap-shaped ornamental body 1 constituted by two rows of the granular ornamental bodies 2,2 . . . 2; 2,2 . . . 2 as shown in FIGS. 4 and 5 are wound and bound together via the adhesive layer 4 made of hot-melt adhesive such that the granular ornamental bodies 2,2 . . . 2; 2,2 . . . 2 of the strap-shaped ornamental body 1 are exposed radially outward and fixed to each other to constitute a shape of a rod in a twisted state. The process of such adhesion, fixation, and retention is described below in order of steps.

First, as a first step, the granular ornamental bodies 2 are selected from among jewel, artificial jewel 2A, bead, noble-metal ball, and metal ball. The granular ornamental bodies 2 are arranged via the connecting member 3 in a plurality of rows (in two rows in the first embodiment) made by the granular ornamental bodies 2,2 . . . 2; 2,2 . . . 2 and then connected to each other to constitute the strap-shaped ornamental body 1.

In order to constitute the strap-shaped ornamental body 1, the connecting member 3 in the first embodiment as shown in FIGS. 4, 6 and 7, the artificial jewels 2A (i.e., the granular ornamental bodies 2) are adhered to the front side of attaching portion 6A of the cross-sectionally-semi-circular attachment ring 6 by the adhesive S (see FIG. 7). After that, the connecting ring 7 having the one end is inserted into the four loop arms 6B, 6C, 6D, and 6E in a shape of a cross in a plan view on the upper side of the attachment ring 6 so that the granular ornamental bodies 2 are bundled together in a planar manner on the reverse side thereof. Thus, the granular ornamental bodies 2 are connected to each other in the desired number of rows on the desired plane to constitute the strap-shaped ornamental body 1 (in the first embodiment, as discussed in the foregoing, in two rows in the width direction W and in the desired length of the strap-shaped ornamental body 1 in the longitudinal direction N).

Next, as a second step, ribbon-shaped adhesion member 5 having on one side thereof the adhesive layer 4 made of the hot-melt adhesive is twisted into a linear shape. This is a preparatory operation.

To achieve this, the one end 5*a* of the adhesion member 5 is secured to the first supporting platform 10. In order to secure the adhesion member 5 to the first supporting platform 10, the chuck mechanism 11 provided on the end of the rotation axis 12 rotatable and driven by the motor M may be used to clamp the one end 5*a* of the adhesion member 5. As an alternative securing technique, though not shown, the one end 5*a* of the adhesion member 5 may be fastened to the end of the rotation axis 12. Subsequently, the motor M is driven to rotate the rotation axis 12 and thereby twist the adhesion member 5 until the diameter thereof becomes approximately 0.5 millimeter and the adhesion member 5 takes a linear shape, and the adhesive layer 4 made of hot-melt adhesive is exposed to radially outward of the adhesion member 5. After that, the adhesion member 5 is cut in a desired length. The cutting may be readily done using scissors or a cutter.

After that, as a third step, the strap-shaped ornamental body 1 is wound around the linear adhesion member 5 having the adhesive layer 4 made of the hot-melt adhesive spirally such that the granular ornamental bodies 2 are exposed radially outward.

In order to wind the strap-shaped ornamental body 1, the one end 5*a* of the adhesion member 5 may be clamped by the chuck mechanism 11 of the first supporting platform, the other end 5*b* of the adhesion member 5 may be clamped by the chuck mechanism 11' of the second supporting platform 10' opposed to the first supporting platform 10. At this point, the one end 5*a* of the adhesion member 5 and the one end 1*a* of the strap-shaped ornamental body 1 are secured by the chuck mechanism 11 of the first supporting platform 10, which is assumed as an origin A. The strap-shaped ornamental body 1 in a desired length is assumed as a terminal point B. The terminal point B is clamped and fixed by the chuck mechanism 11' of the second supporting platform 10'.

Then, the motors M, M' are driven to rotate the rotation axes 12, 12' in the same direction of rotation and at the same speed, thereby the strap-shaped ornamental body 1 is wound around the linear adhesion member 5 spirally such that the granular ornamental bodies 2 are exposed radially outward of the adhesion member 5.

After that, as a fourth step, either the strap-shaped ornamental body 1 and the adhesion member 5, or the heating unit 13 are relatively displaced with respect to the other in the longitudinal direction N and the linear-shaped hot-melt adhesive exposed radially outward of the adhesion member 5 is heated and incited. In the first embodiment, through the relative movement of the heating unit 13 with respect to the strap-shaped ornamental body 1 and the adhesion member 5 in the longitudinal direction N with a distance in order of dozens of millimeters away from the granular ornamental bodies 2, the hot-melt adhesive of the adhesion member 5 is heated and melted, the strap-shaped bodies 1 are is wound together via the adhesion member 5 such that granular ornamental bodies 2,2 . . . 2; 2,2 . . . 2 of the strap-shaped ornamental body 1 are exposed radially outward of the adhesion member 5. Subsequently, the strap-shaped bodies 1 are cooled, adhered and secured to each other to take a shape of a rod.

At this point, the heating temperature of the heating unit 13 may be equal to or more than 400 degrees Celsius in a room at a normal temperature. The heating temperature of this level can be adjusted to facilitate adjustment of a state of adhesion depending upon types of the hot-melt adhesive for use in adhesion, material property, hardness, and dimension of the granular ornamental bodies 2 of the strap-shaped ornamental body 1.

The ornamental rod-like body as the ornamental body that has thus been obtained achieves, by virtue of the artificial jewels 2A, balanced and luxurious decorativeness with multiple-sequential structure.

At this point, in the first embodiment, since the attachment ring 6 of the connecting member 3 includes the attaching portion 6A having the substantially semi-circular cross section, the inner dimension of the attaching portion 6A corresponds to the outer dimension of the mounting place of the granular ornamental bodies 2, and by virtue of an adhesive having good thermal stability so as not to be affected by the heating such as phenoplast, aminoplast, epoxy resin, acrylic resin, alkyd resin, and unsaturated polyester resin can be used to attach the granular ornamental bodies 2 to the attaching portion 6 readily, securely, and with high accuracy of attachment. Also, with regard to the attaching portion 6A of the attachment ring 6, the first embodiment employs the artificial jewel 2A as the granular ornamental bodies 2. This is only a typical example and accordingly the granular ornamental bodies 2 may be made of noble metal, metal, and non-metal material including jewels and beads. Thus, the granular ornamental bodies 2 can be readily and securely attached using the adhesive S.

When the granular ornamental bodies 2 is a jewel, the jewel may include diamond, emerald, sapphire, a ruby, opal, jade, amethyst, quartz crystal, tourmaline, an onyx, coral, and pearl. Also, the noble-metal ball may include gold, gold alloy, platinum, white gold alloy, and silver. Further, the metal ball may include iron, stainless steel, copper, aluminum, and zinc. Thus, the range of application of the granular ornamental bodies 2 is very wide. Also, selection of the granular ornamental bodies 2 to be manufactured may be determined in accordance with user's preference and budgetary constrains, and the user can purchase the product readily.

Also, in the first embodiment, since the connecting member 3, as shown in FIGS. 4, 6, and 7, the connecting ring 7 having the end is inserted into the four loop arms 6B, 6C, 6D, and 6E in a shape of a cross in a plan view are provided, at an upper side of the attaching portion 6A of the attachment ring 6, the loop arms 6B, 6C, 6D, and GE, so that a plurality of the granular ornamental bodies 2 attached to the attachment ring 6 (i.e., in the first embodiment as shown in the figures, four granular ornamental bodies 2 attached to the attachment ring 6) is bound together on a desired plane by means of the single connecting ring 7 (see FIG. 4). Accordingly, the connecting ring 7 is inserted into any of the four loop arms 6B, 6C, 6D, and 6E in a shape of a cross in a plan view are provided at an upper side of the attaching portion 6A of the attachment ring 6 with granular ornamental bodies 2 attached to the attaching portion 6A. The neighboring attachment rings 6 are connected to each other via the connecting ring 7 on the front side vertically and horizontally to connect the granular ornamental bodies 2, and as a result the granular ornamental bodies can be readily and effectively connected to each other in a desired number of rows on a desired plane (in the first embodiment, as shown in FIGS. 3, 4, and 5, two rows of the strap-shaped bodies 1 are connected to each other in a desired length).

At this point, the connecting member 3 of the first embodiment, as has been described in the foregoing, includes the attachment ring 6 having the attaching portion 6A to which the granular ornamental bodies 2 is attached. The attachment ring 6 includes four loop arms 6B, 6C, 6D, and 6E provided at an upper side of the attaching portion 6A in a shape of a cross in a plan view. Furthermore, the connecting ring adapted to be inserted into the loop arms 6B, 6C, 6D, and 6E is a ring having an end. Accordingly, when the desired multiple rows of strap-shaped bodies 1 are wound around the outer periphery of the linear adhesion member 5 in the longitudinal direction N, the a plurality of the attachment rings 6, 6 can be attached with the connecting ring 7 being the center, with a simple attaching operation, and with flexibility in view of mounting direction and mounting angle with respect to an environment. Accordingly, through winding the strap-shaped ornamental body 1 in the longitudinal direction N, when a reverse side is adhered and fixed via the adhesive layer 4 made of hot-melt adhesive exposed on the outer periphery of the linear adhesion member 5, the twisted each row granular ornamental bodies 2,2 . . . 2; 2,2 . . . 2 are arranged radially about the axis and in the same orientation and there is left no irregularity. Accordingly, the granular ornamental bodies 2,2 . . . 2; 2,2 . . . 2 can exhibit high luminance allowing excellent decorativeness.

Also, desired multiple rows of the strap-shaped bodies is obtained by attaching more than one attachment ring 6 with the granular ornamental bodies 2 attached to the attaching portion 6A to the connecting ring 7. The desired multiple rows of the strap-shaped bodies 1 may be fed by a feeding drum (not shown) continuously. Also, strap-shaped ornamental body 1 may be rewound by a retracting drum at its terminal phase in the moving direction X of so that the strap-shaped ornamental body 1 in movement may be placed under tension in the longitudinal direction N, the desired multiple rows of the strap-shaped bodies 1 are wound in the longitudinal direction N around the linear adhesion member 5 whose adhesive layer 4 made of hot-melt adhesive is exposed radially outward at the reverse side of the strap-shaped ornamental body 1. Further, the adhesive layer 4 is heated and melted and the strap-shaped bodies are adhered and fixed together by the adhesive layer 4. When the foregoing processes are consistently and automatically performed, the manufacturing line can automatically produce the ornamental rod-like body of the first embodiment.

The ornamental rod-like body of the first embodiment that has thus been obtained can be used for example in accessories such as necklace, bracelet, and hair accessory, a handle of a handbag, personal effects such as belt, and a strap for camisole and women's undergarments. The range of application is very wide.

Thus, in the ornamental rod-like body of the first embodiment, two rows of the strap-shaped bodies 1 are adhered and fixed together via the adhesive layer 4 made of hot-melt adhesive so as to be held in a wound state. When a strong external force acts upon the multiple rows of strap-shaped bodies 1, the strap-shaped bodies 1 that have been bound together do not loosen or come apart but can be held in the wound state with structural robustness. As a result, excellent decorativeness is achieved. This is in contrast to the ornamental rosary disclosed in the patent literature 1, where the string of beads is held in a state of a twisted mesh by virtue of pulling force of the restoring force of the vinyl through twisting together the strings of beads by passing a coated thread made by impregnating a through-thread with a vinyl through the granular ornamental bodies 2 so as to strongly twist the coated thread.

Furthermore, in the strap-shaped ornamental body of the first embodiment, two rows of granular ornamental bodies 2,2 . . . 2; 2,2 . . . 2 are bound together to constitute the strap-shaped ornamental body 1 via the adhesive layer 4 including the hot-melt adhesive, and adhered, fixed, and retained in a wound state. Accordingly, a raw stones including jewels such as amethyst, quartz crystal, tourmaline, and onyx may be connected in rosary-like manner by a thread. Amasses of the noble metal such as gold alloy, platinum alloy, platinum, and silver may be connected in a rosary-like manner. This is in contrast to an accessory disclosed in the Patent Literature 2, wherein a noble metal net made of noble-metallic ball chain may be wound around an outer periphery of a string-shaped content in the longitudinal direction with respect to the outer periphery. Accordingly, with respect to the thickness of the finished product, thin products such as necklace, bracelet, and other accessories can be manufactured and it can be more light-weighted. Further the manufacturing process can be simplified, facilitating the manufacturing, and the manufacturing costs can be decreased.

Thus, in the first embodiment, as has been mentioned, a plurality of rows of the strap-shaped bodies 1 are used, the rows being arranged on the same plane at an initial stage where application of an adhesive is not necessary. The strap-shaped bodies 1 are adhered and fixed together via the adhesive layer 4 made of ribbon-shaped hot-melt adhesive to provide the ornamental rod-like body that is held in the wound state, so that the ornamental rod-like body can be manufactured and assembled in a short time and in a simple manner with higher manufacturing efficiency and lower manufacturing cost.

Second Embodiment

Referring to FIGS. 9 to 12, there is shown an ornamental rod-like body according to a second embodiment of the present invention. The ornamental rod-like body of the second embodiment may include a strap-shaped ornamental body 1 that includes: granular ornamental bodies 2 selected from among jewel, artificial jewel 2A, bead, noble-metal ball, and metal ball; a connecting member 3 configured to arrange the granular ornamental bodies 2 in a plurality of rows and connect them to each other; an adhesion member 5 to be provided on a reverse side of the connecting member 3, the adhesion member 5 having on both sides thereof adhesive layers 4 made of hot-melt adhesive 4; and a strand-shaped reinforcing core 20 around which the adhesion member 5 is wound. The strap-shaped ornamental body 1 is wound via the adhesion member 5 around the reinforcing core 20 such that the granular ornamental bodies 2 are exposed radially outward and thus is adhered and fixed to the reinforcing core 20 via the adhesive layer 4. Also, in the second embodiment, since the number of rows of the granular ornamental bodies 2 of the strap-shaped ornamental body 1 is expanded to six rows, an area of adhesion has to be increased. To achieve this, the adhesion member 5 has a wide width of 15 millimeters and a length of dozens of meters. Also, the second embodiment also differs from the first embodiment in that the reinforcing core 20 is used. The reinforcing core 20 may be a string woven from natural or artificial fibrous material, or may be made of leather or synthetic resin. In order to increase the strength of pulling and compression, the reinforcing core 20 may incorporate a thin metallic wire such as a piano wire rod and carbon fiber extending inside of the reinforcing core 20.

In order to produce the ornamental rod-like body, first, in the same or similar manner as in the first embodiment, the granular ornamental bodies 2 are selected from among jewel; artificial jewel 2A, bead, noble-metal ball, and metal ball. The granular ornamental bodies 2 are arranged via the connecting member 3 in a plurality of rows (in six rows in the second embodiment) made by the granular ornamental bodies 2 and then connected to each other to constitute the strap-shaped ornamental body 1.

Also, the second embodiment employs the same steps as in the first embodiment regarding connecting process related to arranging the granular ornamental bodies 2 via the connecting member 3 in a plurality of rows to constitute the strap-shaped ornamental body 1, and attaching process related to attaching the granular ornamental bodies 2 to the attachment ring 6.

Next, the adhesion member 5 having on both sides thereof the adhesive layers 4, 4 made of hot-melt adhesive is wound spirally around the outer periphery of the strand-shaped reinforcing core 20. The thickness of the reinforcing core 20 may be defined as appropriate according to the ornamental rod-like body to be manufactured.

At this point, in the second embodiment, in the same way as in the first embodiment, the first supporting member 10 may retain the one end 20*a* of the reinforcing core 20 and the one end 5*a* of the adhesion member 5, and the second supporting member 10 may retain the other end 20*b* of the reinforcing core 20, and then the motors M, M' may rotate in the same direction at the same speed, thereby the adhesion member 5 is wound around the outer periphery of the reinforcing core 20 spirally. At this point, in order to provide adhesion without leaving any untreated portion with regard to the areas of adhesion of the inner-periphery adhesive layer 4 of the adhesion member 5 to the reinforcing core 20, and the outer-periphery adhesive layer 4 to the strap-shaped ornamental body 1 in the subsequent process, the adhesion member 5 is wound spirally around the outer periphery of the reinforcing core 20 such that there exists overlapping in order of several millimeters at the right and left ends in the width direction of the adhesion member 5.

Subsequently, the strap-shaped ornamental body 1 is wound spirally around the outer periphery of the adhesion member 5 such that the granular ornamental bodies 2 of the strap-shaped ornamental body 1 are exposed radially outward. In order to achieve this, the first supporting member 10 may retain the one end 20*a* of the reinforcing core 20, the one end 5*a* of the adhesion member 5, and the one end 1*a* of the strap-shaped ornamental body 1. Also, the second supporting member 10' may retain the other end 20*b* of the reinforcing core 20 and the other end 5*b* of the adhesion member 5 together and then may be driven by the motors M, M' to rotate in the same direction at the same speed, so that the strap-shaped ornamental body 1 is wound spirally around the double-faced adhesion member 5 having both the inner-periphery and the outer-periphery adhesive layers 4, 4 to obtain the desired length.

Subsequently, the heating unit 13 is relatively displaced with respect to the strap-shaped ornamental body 1 and the adhesion member 5 (the relative movement may take place vice versa) in the longitudinal direction N to heat and melt the hot-melt adhesives of the adhesive layers 4 radially inward and outward of the adhesion member 5. In the second embodiment, the heating unit 13 is displaced with respect to the strap-shaped ornamental body 1 and the adhesion member 5 in the longitudinal direction N to heat and melt the hot-melt adhesive of the adhesive layers 4, 4 so that the adhesion member 5 is adhered to the outer periphery of the reinforcing core 20 such that the granular ornamental bodies 2,2 . . . 2; 2,2 . . . 2 of the strap-shaped ornamental body 1 are exposed radially outward. The strap-shaped ornamental body 1 is wound around the outer periphery of the adhesion member 5 for adhesion spirally without any gap left. Also, although not shown, to further increase property of adhesion of the adhesion member 5 having on both sides thereof the adhesive layers 4, 4 with respect to the strap-shaped ornamental body 1, a hot-melt adhesive tape not shown) may be further wound spirally around the outer periphery of the adhesion member 5. The not-shown hot-melt adhesive tape may be made of the same material as in the adhesive layer 4 of the adhesion member 5.

At this point, the heating unit 13 may be a drier or a heater in a similar manner as in the first embodiment. The heating unit 13 is displaced in the longitudinal direction N with a distance of dozens of millimeters away from the granular ornamental bodies 2 to heat the granular ornamental bodies 2. The heating temperature of the heating unit 13 may be equal to or more than 400 degrees Celsius in a room at a normal temperature. The heating temperature of this level can be adjusted to facilitate adjustment of a state of adhesion depending upon types of the hot-melt adhesive for use in adhesion, material property, hardness, and dimension of the granular ornamental bodies 2 of the strap-shaped ornamental body 1.

Figure 11:
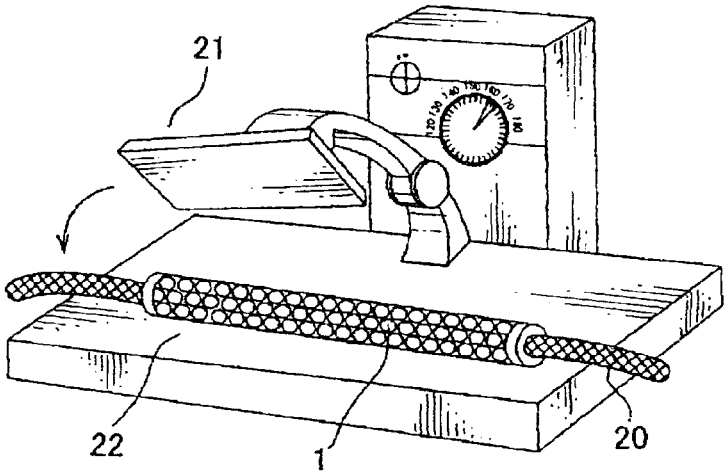
FIG. 11 is a perspective view illustrating a pressing unit for use in the method of the second embodiment.
Figure 12:
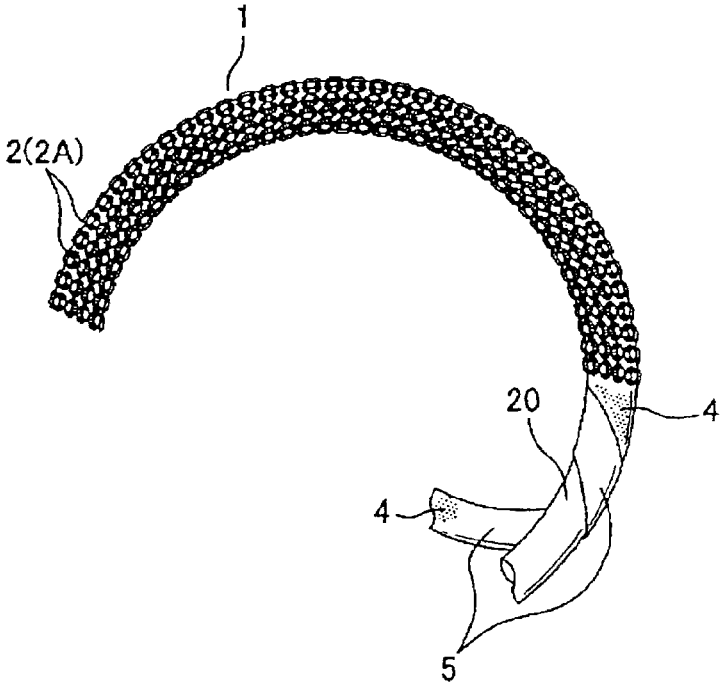
FIG. 12 is a perspective view illustrating an alternative ornamental rod-like body of the present invention.

Further, while the adhesive layer of the hot-melt adhesive tape, the adhesive layer being made of the same material as that of the adhesive layer 4 of the adhesion member 5, is not yet heated, melt, cooled, and solidified around the adhesion member 5 having the hot-melt adhesives of the adhesive layer 4 radially inward of the adhesion member 5 and the adhesive layer 4 radially outward of the adhesion member 5, pressing by the pressing unit 21 shown in FIG. 11 and the heating temperature equal to or more than 150 degrees Celsius are applied to the strap-shaped ornamental body 1, by way of which the position of adhesion and pressure of adhesion of the adhesion member 5 with respect to the reinforcing core 20 (and, if the not-shown hot-melt adhesive tape is wound spirally around the adhesion member 5, also a position of adhesion and pressure of adhesion of the strap-shaped ornamental body 1 with respect to the strap-shaped ornamental body 1) are adjusted so that adhesion property of the adhesive layers 4,4 are strengthened with respect to the externally applied pulling and/or compression to provide structural robustness.

At this point, the direction of pressing by the pressing unit 21 upon the strap-shaped ornamental body 1 may be changed in the vertical direction and in a front-back direction of the strap-shaped ornamental body 1 for example through turning the strap-shaped ornamental body 1 wound around the reinforcing core 20 via the adhesion member 5 on a workbench 22 for example by 90 degrees at a time. Furthermore, pressure imposed by the pressing unit 21 can be adjusted depending upon the material properties, hardness, and dimension of the granular ornamental bodies 2 of the strap-shaped ornamental body 1.

Subsequently, through natural cooling, the granular ornamental bodies 2 of the strap-shaped ornamental body 1 are wound together around the reinforcing core 20 via the adhesion member 5 so that they are exposed to the side of the outer periphery, and also, when hot-melt adhesive tape (not shown) is wound spirally, wound around the reinforcing core 20 via the adhesion member 5 and the hot-melt adhesive tape. Subsequently, through cooling, the strap-shaped ornamental body 1 is bonded and fixed and held in a shape of a rod, and thus the ornamental rod-like body is obtained.

The ornamental rod-like body of the second embodiment that has been thus obtained is wound around the strand-shaped reinforcing core 20 spirally via the adhesion member 5 having on both sides thereof the adhesive layer 4 made of hot-melt adhesive that is to be heated and melted, and through further winding the hot-melt adhesive tape (not shown) around the outer periphery of the adhesion member 5 spirally, in this case, strap-shaped ornamental body 1 are wound together via the adhesion member 5 and the hot-melt adhesive tape. Subsequently, through cooling, with the reinforcing core 20 serving as a core, the strap-shaped ornamental body 1 is bonded and fixed. Accordingly, in contrast to the first embodiment where strap-shaped ornamental body 1 is wound around the linear reinforcing core around which the adhesion member 5 is twisted and wound, in the second embodiment, the strap-shaped ornamental body 1 is protected from being disconnected due to an external force such as pulling and twisting so as to obtain further structural robustness. Furthermore, when the hot-melt adhesive tape (not shown) is wound around the outer periphery of the adhesion member 5 spirally, the strap-shaped ornamental body 1 can be attached with more structural robustness compared with a case where it is wound via the adhesion member 5 around the outer surface of the reinforcing core 20, which is the point where the second embodiment differs from the first embodiment in terms of configuration and functionality, and except for which the first and second embodiments shares the same configuration and functionality.

Also, in the above the embodiment 1 and the above the embodiment 2, the strap-shaped ornamental body 1 obtained by connecting the granular ornamental bodies 2 via the connecting member 3 in the width direction W is described as the granular ornamental bodies 2 that are connected in two or five rows. However, this is illustration of a typical configuration and, although two to eight rows is the most suitable as the number of the granular ornamental bodies 2, the embodiment is not confined to this illustration and the number can be increased, decreased, and modified at discretion.

Also, in the shown first and second embodiments, the granular ornamental bodies 2 of each row of the strap-shaped bodies for ornamental use 1 that are connected via the connecting member 3 have substantially identical diameter and a single color. However, although not shown, for example, the size of the granular ornamental bodies 2 can vary according to the rows, the color of the granular ornamental bodies 2 can vary according to the rows, and further different colors can be assigned to the bodies in order of sequence in the same row, and combination of these configuration is possible in order to exhibit variety in aesthetic appearance.

Also, the connecting member 3 described in the above the embodiment 1 includes the four loop arms 6B, 6C, 6D, and 6E that are provided in the shape of the cross in the plan view on an upper side of the attaching portion 6A of the attachment ring 6. However, the size and dimensions of the loop arms may be different from this. For example, three loop arms may be provided crosswise in a Y-shape in a plan view, and the dimension and the number of the loop arms may be changed as appropriate. Also, the number of attachment rings 6 that are attached to the connecting ring 6 may be increased or decreased so that the number of the granular ornamental bodies 2 can be readily adjusted.

INDUSTRIAL APPLICABILITY

The present invention, when a strong external force acts upon the multiple rows of strap-shaped ornamental body that includes an ornamental body that has been wound and bound together, is capable of achieving shape retention with structural robustness in a state of being wound, with high flexibility when being mounted, without the strap-shaped bodies for ornamental use coming apart, by means of which the granular ornamental body can provide luxurious decorativeness with a balanced and multiple-sequential structure. Also, it is possible to manufacture and assemble in a short time and in a simple manner, and with high manufacturing efficiency, and furthermore, manufacturing and assembling may be performed even when the granular ornamental body is made of non-metal material other than the noble metal and metal, the non-metal material being a jewel, an artificial jewel, and a bead with wide range of application. Also, with respect to the thickness of the finished product, both thin product and thick product can be manufactured and it can be more light-weighted and further the manufacturing costs can be decreased, such application and functionality is suitable.

REFERENCE SIGNS

1 Strap-shaped ornamental body
2 Granular ornamental body
2A Artificial jewel
3 Connecting member
4 Adhesive layer
5 Adhesion member
6 Attachment ring
6A Attaching portion
6B Loop arm
6C Loop arm
6D Loop arm
6E Loop arm
7 Connecting ring
N Longitudinal direction.

What is claimed is:

1. An ornamental rod-like body comprising a strap-shaped ornamental body that includes:

a plurality of granular ornamental bodies selected from the group consisting of a jewel, an artificial jewel, a bead, a noble-metal ball, and a metal ball;

a connecting member configured to arrange the granular ornamental bodies in a plurality of rows and connect the granular ornamental bodies to each other;

an adhesion member, comprising a ribbon-shape base material, having on both sides thereof an adhesive layer comprising a hot-melt adhesive for which the heating temperature is equal to or more than 400 degrees Celsius, the adhesion member being configured to be provided on a backside of the connecting member; and a reinforcing core around which the adhesion member is wound, the strap-shaped ornamental body being adhered and secured to the reinforcing core via the adhesive layer such that the adhesion member is wound around the reinforcement core with the granular ornamental bodies exposed radially outward of the reinforcing core.

2. The ornamental rod-like body according to claim 1, wherein a plurality of the strap-shaped ornamental bodies are bound together, twisted around and secured to the reinforcing core, the strap-shaped ornamental bodies being adhered to the reinforcing core either via the adhesion member wound around the reinforcing core spirally or via a hot-melt adhesive tape wound around an outer periphery of the adhesion member that has been wound around the reinforcing core spirally.

3. The ornamental rod-like body according to claim 1, wherein the connecting member includes:

an attachment ring including a loop arm in a shape of a cross in a plan view, the loop arm being provided on one side of the attachment ring and an attaching portion provided on an other side of the attachment ring opposed to the loop arm, an internal dimension of the attaching portion corresponding to a portion of the granular ornamental body at which the granular ornamental body is attached to the attachment ring; and a connecting ring configured to be inserted into the loop arm of the attaching ring so as to bind together on one plane the granular ornamental bodies that each have been attached to a plurality of the attachment rings such that the granular ornamental bodies are connected to each other in a desired number of rows on a desired plane.

4. The ornamental rod-like body according to claim 3, wherein a plurality of the strap-shaped ornamental bodies are bound together, twisted around and secured to the reinforcing core, the strap-shaped ornamental bodies being adhered to the reinforcing core either via the adhesion member wound around the reinforcing core spirally or via a hot-melt adhesive tape wound around an outer periphery of the adhesion member that has been wound around the reinforcing core spirally.

* * * * *